United States Patent [19]

Regan

[11] 4,416,495

[45] Nov. 22, 1983

[54] CONCENTRIC ELECTRIC CONNECTOR FOR SUBSEA WELL APPARATUS

[75] Inventor: Albert M. Regan, Huntington Beach, Calif.

[73] Assignee: Hughes Tool Company, Houston, Tex.

[21] Appl. No.: 270,736

[22] Filed: Jun. 5, 1981

[51] Int. Cl.[3] ..... H01R 13/523

[52] U.S. Cl. ..... 339/16 C

[58] Field of Search ..... 339/5, 15, 16

[56] References Cited

U.S. PATENT DOCUMENTS

| | | | |
|---|---|---|---|
| 3,360,048 | 12/1967 | Watkins | 166/187 |
| 4,117,287 | 9/1978 | Walker et al. | 339/16 R |
| 6,037,841 | 5/1979 | Watkins | 116/87 |

FOREIGN PATENT DOCUMENTS

| | | | |
|---|---|---|---|
| 1109934 | 4/1965 | Fed. Rep. of Germany | 339/16 R |

*Primary Examiner*—Eugene F. Desmond

*Attorney, Agent, or Firm*—Robert A. Felsman; James E. Bradley

[57] ABSTRACT

An electrical circuit between a floating vessel and electrical apparatus located at a remote subsea location associated with a subsea well is provided with as first electrical conduit connected to a mandrel member run from the vessel, a second electrical conduit run from the remote electrical apparatus to a mandrel receiving socket member associated with the subsea well equipment and a slip fit connect-disconnect electrical connection means provided on the mandrel and socket member with a first contact member on the mandrel and a concentric second contact ring member in the socket member whereby landing and removal, respectively, of the mandrel relative the socket member automatically completes and interrupts, respectively, the electrical circuit between the vessel and the remote electrical apparatus.

4 Claims, 4 Drawing Figures

CONCENTRIC ELECTRIC CONNECTOR FOR SUBSEA WELL APPARATUS

BACKGROUND OF THE INVENTION

The present invention relates to subsea well apparatus and electrical circuit means for controlling or monitoring electrical apparatus located adjacent or in the subsea well at a location remote from an overhead floating vessel from which operations on the well are being conducted. More specifically, the present invention relates to an electrical connector means for providing an automatic connect-disconnect electrical circuit completion concurrent with connection of the vessel hung apparatus with the well head apparatus.

It is common in subsea well operations to suspend long lengths of tubing for drilling or production operations from a floating vessel to a subsea well head with means for automatically disconnecting the vessel from the well head in the event of rough sea conditions as well as to simplify normal hookup or disconnect operations between the vessel and well. In the prior U.S. Patent application Ser. No. 37,841 filed May 10, 1979 entitled "IMPROVED ANNULUS VALVE" a tubing hanger and annulus valve apparatus is disclosed which provides for an automatic connect-disconnect of the vessel with well head apparatus with provision for making up a hydraulic connection on landing of an associated mandrel member in the tubing hanger and annulus valve apparatus. However, it is also desirable to operate electrical apparatus down hole to monitor well conditions such as fluid temperatures. It would therefore be desirable to be able to provide an electrical circuit between the vessel and down hole well apparatus which could be completed or interrupted by the connection, or disconnection, respectively, of the vessel associated apparatus relative to the well head associated apparatus. Such a connection will have to be operable in the environment of the subsea where water presence and pressure will tend to cause an electrical connection to fail and should be easily and repeatably completed or interrupted concurrently with normal completion or disassembly of the subsea well apparatus run between the floating vessel and the subsea well.

It is therefore the primary object of the present invention to provide a subsea well apparatus electrical connector means for automatically providing a completed electrical circuit between down hole electrical and overhead remote floating vessel concurrent with the makeup of the riser or tubing string apparatus between the vessel and well. More specifically, it is an object of the present invention to disclose and provide a concentric electrical connector means suitable for use in association with the completion of a subsea well connection between a mandrel run from the floating vessel and a tubing or casing hanger apparatus in which the mandrel is landed in order to effect completion of the electrical circuit between the vessel and associated down hole electrical apparatus concurrent with the makeup of the mandrel-tubing or casing hanger apparatus in the subsea environment.

SUMMARY OF THE INVENTION

Generally stated the present invention is subsea well apparatus electrical connector means is contemplated as being employed in association with a tubing mandrel which may be associated with the christmas of well apparatus run from a floating vessel and which is removably landed in a tubing hanger associated with the well head and includes the provision of a first electrical contact member on the mandrel and a second electrical contact member in the tubing hanger for automatically completing an electrical circuit between the vessel and down hole apparatus by the landing of the mandrel in the tubing hanger. More specifically, the first electrical contact member on the mandrel may comprise a contact finger partially protruding from a side of the mandrel with the second contact member comprising an annular slip ring provided within the bore of the tubing hanger to provide a concentrically oriented slip ring about the mandrel when the mandrel is landed in the tubing hanger bore. The contact finger on the mandrel may be enclosed within a sleeve of dielectric material which is provided with fluid sealing means in spaced relation above and below when the contact finger is exposed to the slip ring to provide a fluid tight environment for the electrical contacts.

A more complete understanding of the present invention in electrical connector means for subsea well apparatus will be afforded to those skilled in the art from a consideration of the following detailed description of an exemplary embodiment thereof. Reference will be made to the appended sheets of drawings which will first be described briefly.

Figure 3:
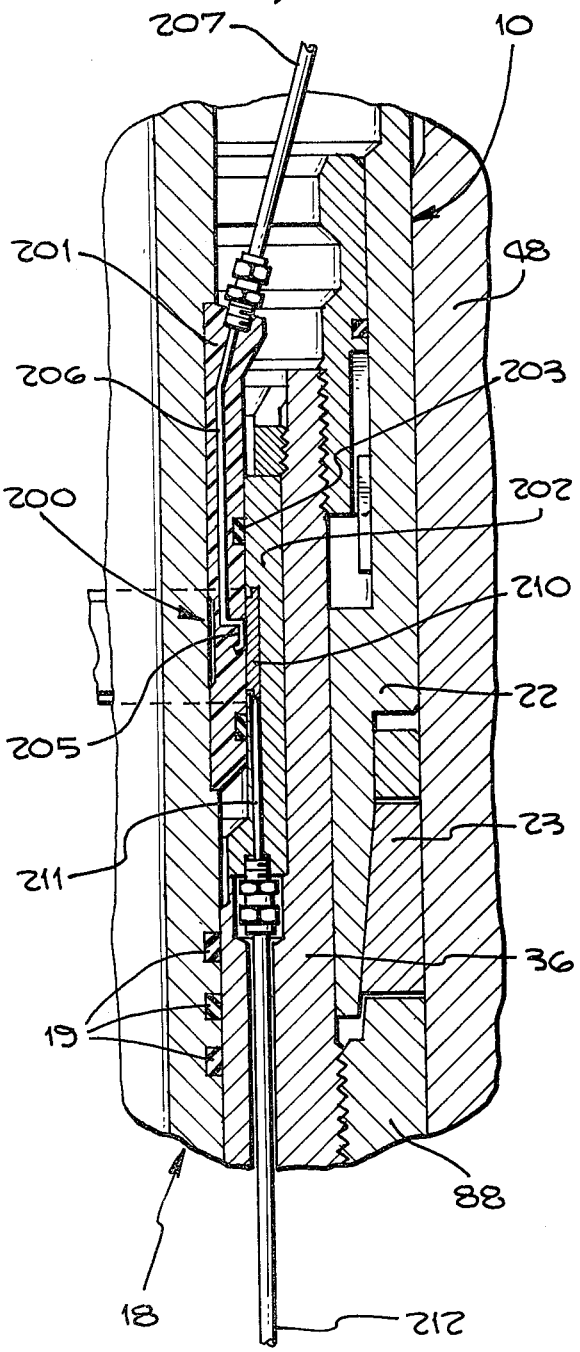
FIG. 3 is a detail section view of the apparatus and exemplary embodiment of connector of FIG. 2 showing the major portions of the present exemplary embodiment of invention in concentric electrical connector in detail.

DETAILED DESCRIPTION OF A PREFERRED EXEMPLARY EMBODIMENT:

A preferred exemplary embodiment of the present invention in concentric electrical connector for subsea well apparatus, and particularly for completing an electrical circuit between a floating vessel and electrical apparatus down hole in the well, is indicated generally at 200 in FIGS. 2 and 3. The preferred exemplary embodiment is incorporated into, and finds a preferred use in the environment of, the tubing hanger and annulus valve apparatus of prior U.S. Patent application Ser. No. 37,841 and filed May 10, 1979 entitled "Improved Annulus Valve". Before describing the present invention in concentric electrical connector for a subsea well apparatus, therefore, a general description will be given of the tubing hanger and annulus valve apparatus in which the present exemplary embodiment of concentric electrical connector is illustrated, the disclosure of said prior patent application being incorporated herein by this reference.

Figure 1:
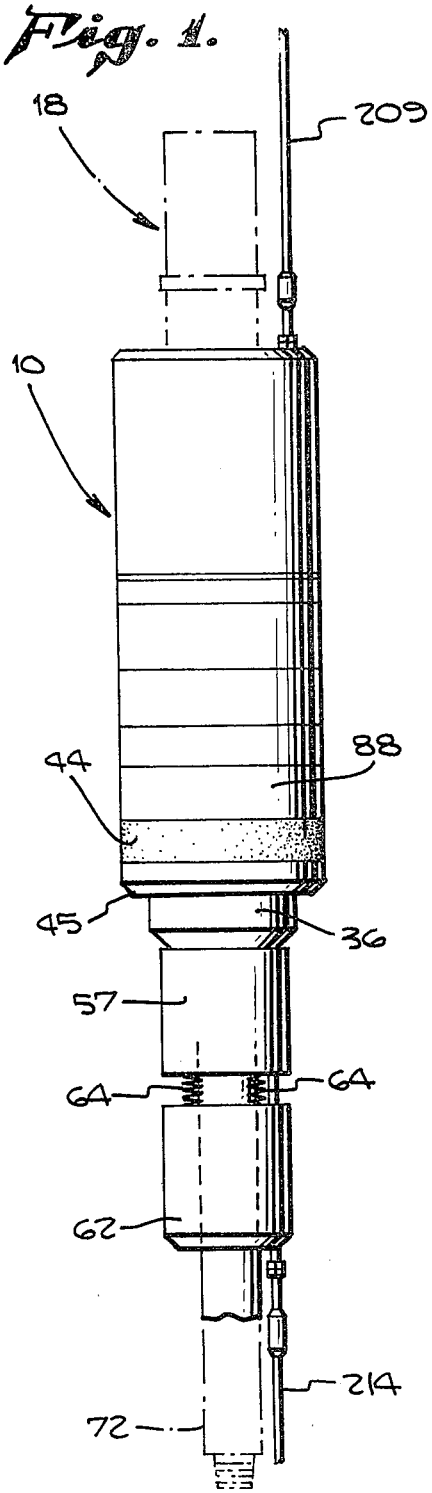
FIG. 1 is an elevational view of an exemplary embodiment of subsea tubing hanger and annulus valve apparatus shown with a removable mandrel, indicated in broken line, in which the use of the present invention in concentric electrical connector is particularly well suited.

Referring now to FIG. 1, the exemplary embodiment of tubing hanger and annulus valve apparatus is indicated generally at 10. As seen in FIG. 2*b*, the tubing hanger, indicated generally at 10, is provided with a packing assembly 24 about a lower portion thereof adjacent landing collar 45 by which the tubing hanger can be landed upon shoulder 46 of the associated well head casing 48. The tubing hanger body 36 seats on the collar 45, as seen in FIG. 2*b*, and is held down by the sleeve 22 which acts against wedge ring 23 above compression ring 88, ring 88 being threaded to body 36 and also functioning to compress packing 44.

When the tubing hanger and annulus valve apparatus indicated generally at 10 is landed within the well head casing 48, as seen in FIG. 2, the christmas tree 12 is landed on well head 48 with a metal-to-metal seal ring 28 positioned therebetween as seen in FIG. 2. A well head latch 14 with hydraulically operated dogs 30 may be employed in known manner for maintaining the christmas tree 12 to the well head 48.

Figure 2A:
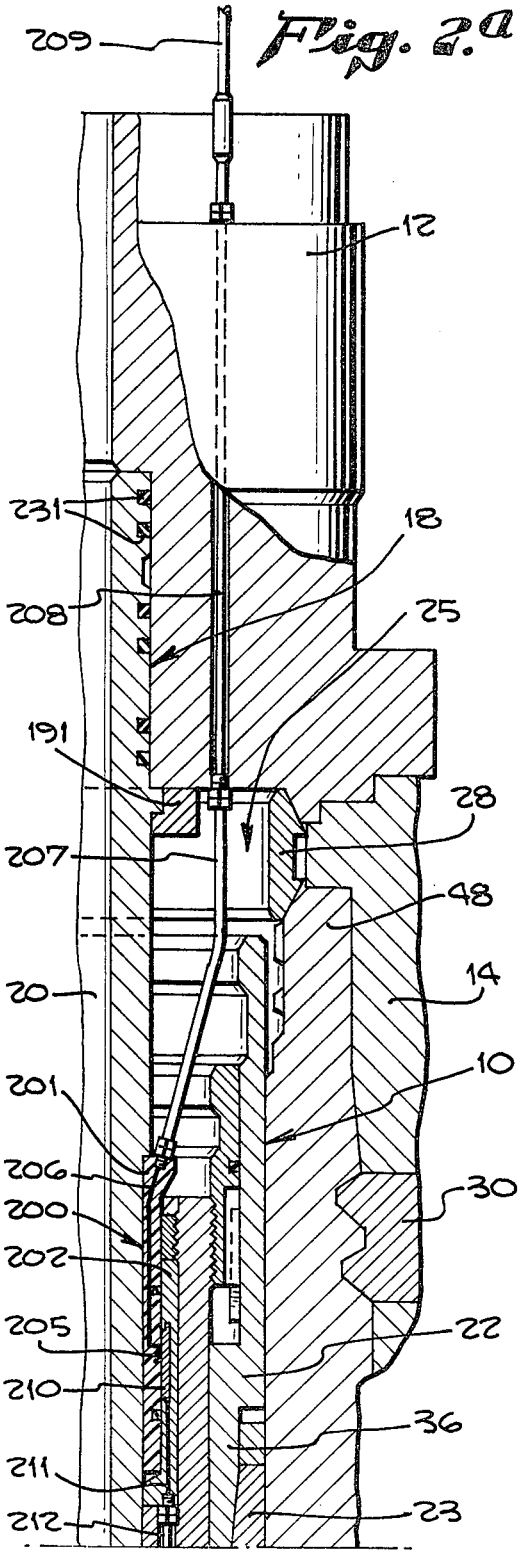
FIG. 2, divided into sections 2*a* and 2*b*, is a vertical section view through the exemplary tubing hanger and annulus valve apparatus of FIG. 1 shown landed in a well head casing with a preferred exemplary embodiment of concentric electrical connector in accordance with the present invention embodied therein.
Figure 2B:
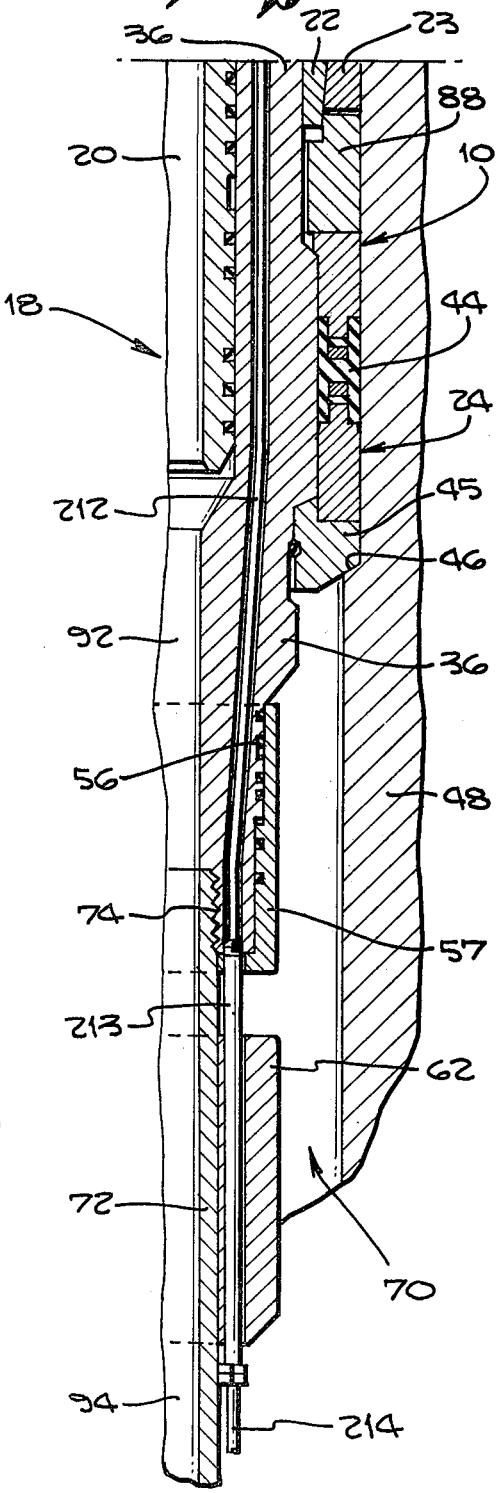

A tubing mandrel, indicated generally at 18, shown in dotted line in FIG. 1 and in solid line in FIGS. 2 and 3, is mounted to the christmas tree 12 by a collar 191 as seen in FIG. 2*a*. The tubing mandrel is sealed by appropriate fluid seals 231 to the christmas tree and provides an internal bore 20 communicating with the tubing hanger bore 92 and lower bore 94 of the upper section of tubing 72 which is suspended from the tubing hanger by threads 74 as seen in FIG. 2*b*.

As in the prior application Ser. No. 37,841, an upper annulus indicated generally at 25 is formed within the well head casing-tubing mandrel annulus which is connected by an annulus valve to a lower annulus, indicated generally at 70, formed between the well head casing 48 and lower portions of the tubing hanger. The annulus valve is not shown in detail in the within disclosure, as it is in said application Ser. No. 37,841, but, for purposes of the present illustration, those skilled in the art should note that it comprises a sleeve member 57 mounted about a lower portion of the tubing hanger body 36 and is biased by springs 64 supported by a support collar 62 into a closed position as seen in FIG. 2*b*. Fluid passages, the outlet port at the annulus valve being indicated generally at 56, may be opened or closed by operation of the annulus valve 57, as more fully described in said application Ser. No. 37,841, with the valve being closed under the spring bias of springs 64 and opened under the application of hydraulic fluid pressure supplied by lines run from the vessel and connected through the connection of the mandrel to the tubing hanger.

The description thus far is of the environment in which the present invention in concentric electrical connector finds particularly suitable use. As is particularly contemplated within the present invention, electrical connector means are provided by the invention in order to provide a completion of an electrical circuit from a floating vessel to a remote subsea well location where down hole electrical apparatus may be in use for monitoring the temperature or other well conditions which can be converted into electrical impulses for transmission to the vessel. The exemplary embodiment of such electrical connector apparatus is illustrated generally at 200 in FIGS. 2 and 3 and will now be described in detail.

Referring to FIGS. 2 and 3, the preferred exemplary embodiment of concentric electrical connector apparatus is illustrated generally at 200 and comprises the provision of a sleeve member 201, preferably made of a dielectric material, mounted in a circumferential groove on the mandrel 18, an electrical contact finger 205, preferably of an electrically conductive material, and a concentrically oriented electrical conductive slip ring 210 provided in the tubing hanger bore. Specifically, a socket member 202 is preferably mounted within the upper bore of tubing hanger body 36 as best seen in FIG. 3, with the electrically conductive material annular ring 210 located on an inner surface thereof and exposed the full 360 degrees about the interior surface thereof. An electric circuit wire 211 connects ring 210 to down hole electrical apparatus via the protecting electrical conduit means including conduits 212, 213 and 214, as best seen in FIGS. 3 and 2*b*.

The dielectrical material sleeve 201 is provided with a fluid seal 203 to seal against the socket member 202 on landing of mandrel 18 within the tubing hanger body 36 as best seen in FIG. 3. Annular seal means 19 seal lower portions of the mandrel to the tubing hanger body 36 to limit the flow of well fluids into the area where sleeve 201 lands within socket member 202. The electrically conductive material contact finger, indicated generally at 205, is embedded in the dielectric material with a circuit wire 206 being connected thereto and running through associated electrical conduit means including conduits 207, 208 and 209, as best seen in FIGS. 3 and 2*a*, to the floating vessel generally located above the subsea well. The contact finger 205 is at least partially exposed on an exterior surface of the dielectric material sleeve 201 to directly engage in an electrical contact with the slip ring 210 on landing of the mandrel 18 and its associated sleeve 201 in the tubing hanger body 36 and its associated socket member 202. The contact finger 205 may be given some resiliency through the resiliency of the dielectric material or the physical characteristics of the contact finger itself, such as by using a spring finger arrangement, whereby a good electrical contact is assured between the first contact means of the finger 205 and the second contact means of the slip ring 210.

It should now be apparent to those skilled in the art from a consideration of the foregoing detailed explanation of a preferred exemplary embodiment of concentric electrical connector, in accordance with the present invention, described in the environment of an exemplary embodiment of tubing hanger and annulus valve apparatus, that the foregoing objects and advantages stated for the within invention have been attained. An electrical connection can be completed between a floating vessel and remotely located electrical apparatus at or adjacent a subsea well installation. The electrical apparatus may be down hole in the well or located adjacent the well head. By the use of a concentric arrangement for the electrical connector the slip fit arrangement of a mandrel landed within a socket member is utilized by the present invention to faciliate the remote connection of the electrical connection of the within invention. Specifically, the present invention finds particular use in the landing of a mandrel member in a tubing hanger wherein down hole operations are controlled by the running of hydraulic control fluids through portions of the mandrel and tubing hanger to control apparatus such as the exemplary annulus valve or other down hole hydraulically operated fluid devices. When a mandrel member, in this environment, or others, is employed for a slip fit connection to an associated socket member in a subsea well apparatus, the present invention in concentric electrical connector finds particularly suitable use in order to concurrently effect the completion, or interruption, of an electrical circuit from the floating vessel and the subsea well electrical apparatus by the connection and disconnection, respectively, of the vessel associated equipment from the well head associated equipment.

The present invention provides an annular concentric electrical connector which allows the production tubing run to pass through the center of the electrical connector; a connector which is wet make and break and can withstand external pressures; a connector which allows an electrical line to pass through a tubing hanger to monitor down hole instrumentation without requiring the christmas tree to be radially oriented with respect to the tubing hanger; and a connector construction which eliminates pockets which could collect debris and prevent the connection from successfully making up.

It should also be understood by those skilled in the art that various modifications, alterations and alternate embodiments may be made of the present invention in concentric electrical connector for subsea well apparatus to floating vessel circuits which come within the scope of the present invention which is defined by the following claims.

I claim:

1. In a subsea well apparatus having a tubing mandrel associated with a christmas tree of the well and being removably landed in a tubing hanger associated with the wellhead, the improvement comprising:

a socket having an interior cylindrical wall carried in the tubing hanger and an electrical contact member located in the inner wall and exposed to the interior of the socket;

the mandrel carrying an exterior wall dimensioned for sliding, telescoping reception within the socket and an electrical contact member located in the exterior wall and exposed to the exterior of the mandrel, the mandrel electrical contact member being positioned for engaging the socket contact member when the mandrel is landed; and upper and lower annular seal means located in one of the walls above and below the contact members for purging environmental liquid from the contact members as the mandrel lands in the socket and for sealing the contact members from environmental liquid when engaged.

2. A method of making an electrical connection between a floating vessel and an electrical apparatus located at a subsea location associated with a subsea well having a tubing hanger carried in a well head, comprising in combination:

mounting in the tubing hanger a socket having an interior cylindrical wall and a contact member of electrically conductive material mounted in the wall and exposed to sea water in the interior of the socket, and connecting an electrical conduit between the electrical apparatus and the socket contact member;

mounting to a mandrel carried by a christmas tree a sleeve having an electrical contact member mounted in an exterior wall and exposed to the exterior, and connecting an electrical conduit between the sleeve contact member and the vessel;

providing that one of the contact members be a cylindrical ring and the other be a resiliently carried finger;

providing upper and lower annular seal means in one of the walls; and lowering the christmas tree onto the well, inserting the mandrel into the socket, purging sea water from the vicinity of the contact members with the seal means, and sliding the contact members into engagement with each other.

3. An electrical connector between a floating vessel and an electrical apparatus located at a subsea location associated with a subsea well, comprising in combination:

a socket carried in the subsea well and having an interior cylindrical wall containing a contact member of electrically conductive material mounted in the wall and exposed to the interior of the socket;

a lower electrical conduit extending from the electrical apparatus to the socket contact member;

a mandrel having an interior bore and carrying an exterior cylindrical wall dimensioned for sliding, telescoping reception within the socket;

an electrical contact member mounted in the exterior wall and exposed to the exterior for sliding contact with the socket contact member when the mandrel is received with the socket;

an upper electrical conduit extending exterior of the mandrel bore from the mandrel contact member to the vessel; and upper and lower resilient seal rings sealingly located between the mandrel and socket walls above and below the contact members; and at least one of the contact members being resiliently mounted so as to be urged into electrical contact with the contact member.

4. An electrical connector between a floating vessel and an electrical apparatus located at a subsea location associated with a subsea well, comprising in combination:

a socket carried in a tubing hanger associated with the well and having an interior cylindrical wall;

a contact member of electrically conductive material mounted in the wall and exposed to the interior of the socket;

a lower electrical conduit extending from the electrical apparatus to the socket contact member;

a sleeve of dielectric material carried by a tubing mandrel associated with a christmas tree of the well, the sleeve having a cylindrical wall dimensioned for telescoping sliding reception in the socket;

an electrical contact member mounted to the wall of sleeve for slidingly engaging the contact ring;

an upper electrical conduit extending exterior of a bore in the mandrel from the mandrel contact member to the vessel;

one of the contact members being an annular ring and the other being a resiliently mounted finger; and upper and lower seal means located in one of the walls above and below the contact member for wiping sea water from the contact members as the mandrel lands in the socket and for sealing the contact members from sea water when engaged.

* * * * *